United States Patent [19]

Summers

[11] Patent Number: 4,885,962

[45] Date of Patent: Dec. 12, 1989

[54] PNEUMATIC TORQUE WRENCH FOR VALVE HANDWHEELS

[76] Inventor: Ronald L. Summers, 5245 Bergh Dr., Anaheim, Calif. 92807

[21] Appl. No.: 306,055

[22] Filed: Feb. 6, 1989

[51] Int. Cl.[4] ..... B25B 17/00

[52] U.S. Cl. ..... 81/57.31; 81/57.44; 81/176.2

[58] Field of Search ..... 81/57, 57.13, 57.14, 81/57.3, 57.44, 176.1–176.3, 74, 75

[56] References Cited

U.S. PATENT DOCUMENTS

| | | | |
|---|---|---|---|
| 983,562 | 2/1911 | Murray | 81/176.2 X |
| 2,402,477 | 6/1946 | Williams | 81/176.15 |
| 2,634,630 | 4/1953 | Johnson | 81/57.31 X |
| 3,992,964 | 11/1976 | Osmond | 81/57.31 |

*Primary Examiner*—James G. Smith

*Attorney, Agent, or Firm*—Philip D. Junkins

[57] ABSTRACT

An air driven torque wrench adaptable to turn spoked handwheels of a wide variety of large valves to effect opening and closing of such. The wrench mechanism includes a head portion, central air turbine wheel which is rotated by air flow and forced in either a clockwise or counter-clockwise direction. The air turbine wheel has gear teeth on its outer periphery which drive a number of meshing spur gears located in uniformly spaced position about the turbine wheel. The spur gears in turn drive an outer annular gear wheel or ring, having inner peripheral gear teeth which mesh with and are driven by rotation of the spur gears. The annular gear wheel includes in its outer periphery a bearing race or track which mates with an outer annular bearing race affixed to and supported by the outer wrench head housing, the two mating bearing races enclosing a series of bearings maintained in equally spaced position by a bearing frame between the races. Air inlets associated with the wrench head section deliver air under pressure to the turbine wheel to rotate same and thereby rotate with increased force the annular gear ring. A wrench handle section extends outwardly from the wrench head housing. Drive lugs mounted to the underside of the annular gear ring interact with and drive a circular torque plate which has grip elements for removable attachment to the spokes of valve handwheels.

12 Claims, 2 Drawing Sheets

PNEUMATIC TORQUE WRENCH FOR VALVE HANDWHEELS

BACKGROUND OF THE INVENTION

1. Field of the Invention.

The present invention relates to power tools driven by pneumatic force means. More particularly, the invention relates to air driven power tools for applying high torque forces to turn objects.

2. Description of the Prior Art.

For many years tradesmen and workmen of many skill and trade classifications have used pneumatic power tools, i.e., tools driven by air. Thus, gun type reversible impact air wrenches of many types and designs have been used, particularly by auto service personnel, for loosening and removing, and for applying and tightening, the machine nuts applied to the lug bolts by which automobile wheels are mounted. Further, reversible air driven ratchets have been used by auto and other mechanics to set and remove machine nuts and bolts and other hand held pneumatic tools have been designed and manufactured as rotary drills, reamers and tapping machines and for driving screw driver blades and other mechanical tools and implements. All of such tools and devices have quick connect means for attachment of the tool or device to a flexible air hose of the type commonly available in auto repair and service garages, machine shops, oil refineries, chemical and power plants and other facilities wherein machinery, piping and devices of all types are in service, use and/or under repair..

In oil refineries, chemical plants, power plants and other industrial facilities (also outside or exposed pipe lines) there are multiple systems of heavy pipe lines with associated valves. Such valves, including large gate valves, globe valves, angle valves and cross valves, are most commonly operated by handwheels which may have a diameter of as much as 24 inches and greater. The handwheels (usually of rim and spoke design) drive inside or outside screw stems which lift (open) or drop (close) or otherwise move the valve disk with respect to the valve seat. For large gate valves, used in pipe lines of twelve or more inches in internal diameter, it may require fifty or more turns of the valve handwheel to fully open or close the valve. Frequently, where large gate, globe and angle valves are not regularly opened and closed or are exposed to corrosive atmospheres, hand operated valves stick or "freeze" in one position or another and the opening or closing thereof requires the application of heavy to extreme torque force to the handwheel to free or "break" the locking forces (corrosion, etc.) tending to hold the valve components in place. Even where such valves are operated regularly, heavy torque forces may be required to be applied to the valve's handwheel by a plant operator or mechanic to open or close the valve over a great number of handwheel turns.

It is an object of the present invention to provide a pneumatic torque wrench adapted for use in the force rotation of handwheels associated with large gate valves, globe valves, angle valves and cross valves.

It is another object of the invention to provide an air driven torque wrench which is adaptable to the spoked handwheels of a wide variety of large pipe line valves and which apply sufficient torque force to the handwheels to "break" the sticking forces commonly associated with such valves and thereafter rotate the handwheels to the extent of desired open or closed valve positions.

Other objects and advantages of the invention will be apparent from the following summary and detailed description of the invention, taken together with the accompanying drawing figures.

SUMMARY OF THE INVENTION

The present invention relates to an air driven torque wrench which is adaptable to the spoked handwheels of a wide variety of large gate, globe, angle and cross valves to turn such handwheels and thereby effect the opening and closing of such valves. The wrench mechanism includes in a head portion a central air turbine wheel which may be rotated by air flow and forced in either a clockwise or a counter-clockwise direction. The air turbine wheel bears on its outer periphery a series of gear teeth which drive a number of meshing spur gears located in uniformly spaced position about the turbine wheel. The spur gears in turn drive an outer annular gear wheel or ring, such wheel bearing an inner peripheral series of gear teeth which mesh with and are driven by rotation of the spur gears. The annular gear wheel includes in its outer periphery a ball race or track which mates with an outer annular ball race affixed to and supported by the main outer wrench head housing, the two mating ball races enclosing a series of bearing balls maintained in equally spaced position by a ball frame between the races.

In addition to supporting the outer annular ball race, the main wrench head housing supports the air turbine wheel via its central hub and the housing supports and positions the group of spur gears providing rotary power connection between the turbine wheel and the annular gear wheel. The wrench head also includes a bottom closure plate which supports the central hub of the air turbine wheel and supports and positions (from the bottom of the wrench head) the spur gears. The main outer wrench head housing bears air delivery channels interconnecting the air turbine wheel with an air delivery line and such housing has attached thereto a wrench handle of sufficient length and mass. The air delivery line, for the most part, is contained within the wrench handle and includes at the terminal end of the handle a quick connect coupling for attachment of the wrench to an air supply hose. The wrench handle includes air supply and air cut-off means interconnected to the handle-enclosed air delivery line. The air delivery channels, associated with the air turbine wheel, include an air throttle valve and an air direction valve for determining the direction of rotation of the turbine wheel and thus the direction which the wrench will turn the handwheel to which it is applied. The bottom closure plate includes an air exhaust channel or port through which the air propelling the air turbine wheel leaves the wrench after traveling once about the turbine drive space within the wrench head.

The annular gear wheel, driven by the central air turbine (through the spur gears), includes a series of equally spaced, downwardly projecting wrench drive lugs. The wrench drive lugs interact with, and in turn drive, a torque plate which is designed to be positioned on and rotate the handwheels of large gate, globe, angle and cross valves. The mechanical connection between the torque plate and valve handwheel is made by valve wheel spoke grips borne by the torque plate. A series of torque plates are designed and utilized to make the connection between the torque wrench of the invention and a wide variety of handwheels which are principally distinguished from one-another by their diameter and number of spokes.

The air turbine wheel of the present pneumatic torque wrench (with its outer rim of gear teeth), in driving the annular gear wheel through the spur gears, produces a strong handwheel-turning torque force when the wrench is applied to the handwheel of a large valve with the wrench handle held by an operator against the turning forces of the wrench. If the valve is "frozen," the air turbine wheel stops its rotation and the operator can apply direct (greater) torque force to the valve's handwheel through the wrench handle. Once the valve is freed ("unfrozen") the air turbine wheel agains proceeds to rotate under air driven force and the valve's handwheel is moved in clockwise or counter-clockwise fashion to the desired point of valve opening or closure.

BRIEF OF THE DRAWING FIGURES

Figure 6:
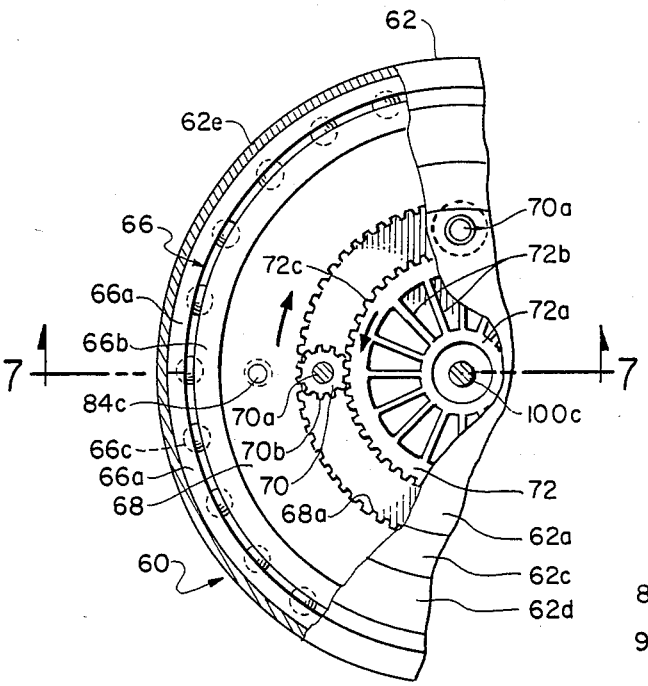
FIG. 6 is a partial top view of an alternative form of the pneumatic torque wrench of the present invention with part of the wrench head housing cut away to show the wrench head's internal arrangement of modified air turbine wheel, spur gears, annualar gear wheel, and outer annular ball bearing and bearing race arrangement.
Figure 9:
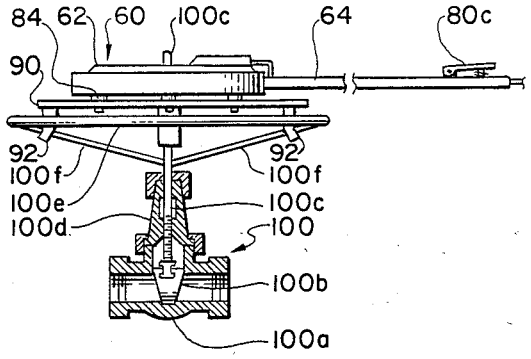
Figure 7:
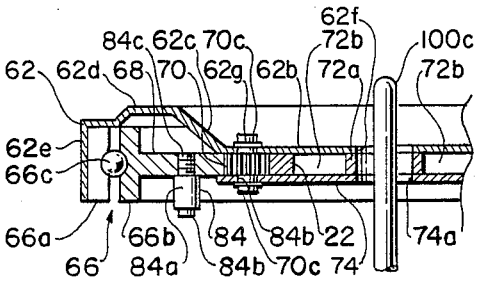
FIG. 7 is a partial side sectional view of the alternative form of the torque wrench of the invention taken on line 7—7 of FIG. 6.
Figure 8:
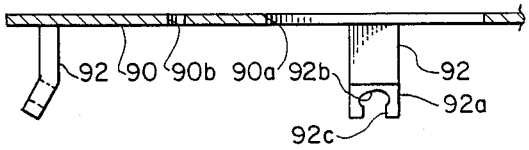

FIG. 8 is a partial side section view of a modified torque plate of the type used to interconnect the alternative form of the torque wrench of the invention as shown in FIGS. 6 and 7 to an alternative form of a handwheel of a large gate, globe, or cross valve; and FIG. 9 is a side view of the alternative form of the pneumatic torque wrench of the invention in operative position, with an associated torque plate of the type shown in partial view in FIG. 8, on an alternative form of a handwheel of a gate valve.

DETAILED DESCRIPTION OF THE INVENTION

Figure 1:
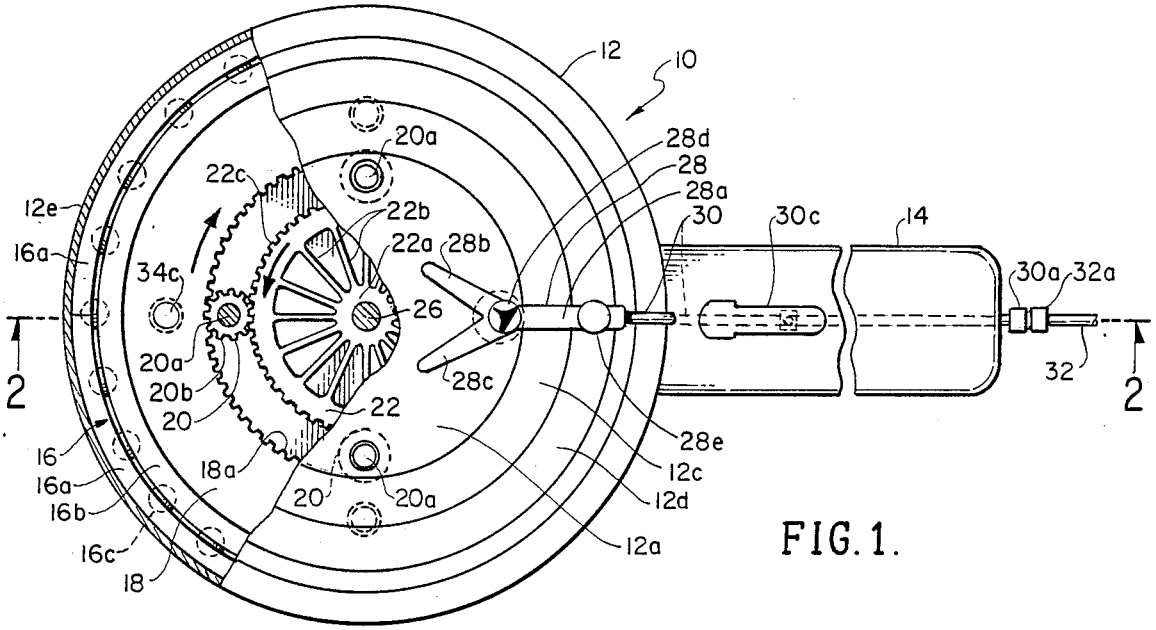
FIG. 1 is a top view of the pneumatic torque wrench of the present invention with part of the wrench head housing cut away to show the wrench head's internal arrangement of air turbine wheel, spur gears, annular gear wheel, and outer annular ball bearing and bearing race arrangement.
Figure 2:
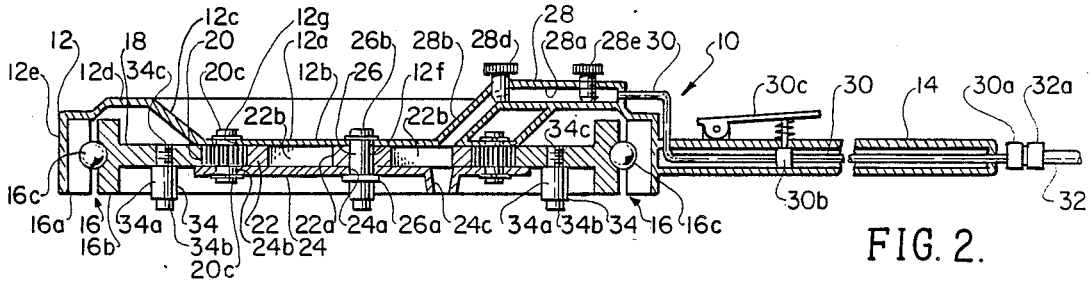
FIG. 2 is a side sectional view of the torque wrench of the invention taken on line 2—2 of FIG. 1.

Referring initially to FIGS. 1 and 2 there is illustrated a reversible pneumatic torque wrench 10 in accordance with the present invention. The wrench 10 is adapted for use in the force rotation of handwheels associated with large gate, globe, angle and cross valves of the type commonly installed in oil refineries, chemical and power plants, and other industrial facilities. The basic components of the torque wrench 10 are its head section 12 and handle section 14. The head section 12 includes a main wrench-head housing 12*a* comprised of a central turbine cover portion 12*b*, annular transition wall portion 12*c*, outer annular bearing race cover portion 12*d* and outer annular (depending) housing wall portion 12*e*. The central turbine cover portion 12*b* of the head housing 12*a* includes a central turbine shaft opening 12*f* and spur gear shaft openings 12*g* outwardly spaced from the turbine shaft opening.

The wrench-head housing 12*a*, via its outer annular wall portion 12*e*, supports a ball bearing assembly 16 including a sectioned outer ball race 16*a*, inner ball race 16*b* and bearing balls 6*c*. The annular outer race 16*a* is affixed to the housing wall portion 12*e* in known manner and through the bearing balls 16*c* supports and stabilizes (within the wrench-head housing) the inner ball race 16*b*. The balls of bearing assembly 16 are maintained in equally spaced position by a ball frame (not shown) of known construction which is positioned between the races 16*a* and 16*b* of bearing 16.. The inner ball race 16*b* comprises the peripheral portion of annular gear wheel 18 which bears about its inner periphery gear teeth 18*a*. Intermeshed with the gear teeth 18*a* of gear wheel 18 is an inner annular array of evenly spaced spur gears 20 which are each positioned by their respective gear shafts 20*a* (extending through gear shaft openings 12*g* in turbine cover portion 12*b* of housing 12*a*) so that their gear teeth 20*b* properly mesh with the gear teeth 18*a*.

Centrally located within wrench-head housing 12*a* is an air turbine wheel 22 which includes a central hub 22*a* from which air vanes 22*b* extend radially to wheel 22. Air turbine wheel 22 bears on its outer periphery gear teeth 22*c* which mesh with the gear teeth 20*b* of the spur gears 20. The turbine wheel 22 is supported on bottom plate 24 of the wrench head 12. At the midpoint of bottom plate 24 there is located a central turbine shaft opening 24*a* and outwardly spaced therefrom are spur gear shaft openings 24*b*. The turbine shaft opening 24*a* of the bottom plate 24 is aligned with the turbine shaft opening 12*f* in the central turbine cover portion 12*b* of housing 12*a* and the spur gear shaft openings 24*b* of the bottom plate 24 are aligned with the spur gear shaft openings 12*g* in the turbine cover portion 12*b* of housing 12*a*. The air turbine wheel 22 rotates about turbine shaft 26 which extends centrally between shaft opening 12*f* of turbine cover portion 12*b* of housing 12*a* and shaft opening 24*a* of the bottom plate 24 with such shaft being locked between cover portion 12*b* and bottom plate 24 by shaft head 26*a* and lock nut 26*b*. The spur gear shafts 20*a* are affixed to spur gears 20 and extend through the aligned shaft openings 12*g* in the turbine cover portion 12*b* of housing 12*a* and the shaft openings 24*b* in bottom plate 24. The spur gear shafts 20*a* are locked in shaft openings 12*g* and 24*b* by lock nuts 20*c*. The bottom plate 24, via its connection to housing 12*a* through turbine shaft 26 and spur gear shafts 20*a*, supports the air turbine wheel 22, spur gears 20 and inner periphery of annular gear wheel 18.

The wrench head section 12 of pneumatic torque wrench 10 is provided with air delivery means 28 comprised of a main air channel 28*a*, mounted to wrench-head housing 12*a*, turbine air nozzles 28*b* and 28*c*, an air flow direction valve 28*d*, and an air throttle valve 28*e*. The air flow direction valve 28*d* directs air from air channel 28*a* into either air nozzle 28*b* or air nozzle 28*c*. Air nozzle 28*b* directs air to the turbine vanes 22*b* so that turbine wheel 22 is driven in a counter-clockwise direction, thereby driving the spur gears 20 in a clockwise direction and in turn the annular gear wheel 18 in a clockwise direction. Air nozzle 28c directs air to the turbine vanes 22b so that the turbine wheel 22 is driven in a clockwise direction, thereby driving the spur gears in a counter-clockwise direction and in turn the annular gear wheel 18 in a counter-clockwise direction. The air entering turbine wheel 22 through either air nozzle 28b or air nozzle 28c, after performing its work on the turbine vanes during one rotation of the turbine wheel, is exhausted from the turbine wheel through exhaust channel 24c in the bottom plate 24. The air throttle valve 28e regulates air flow rate to the operative nozzle 28b or 28c as directed by flow direction valve 28d.

The main air channel 28a of the air delivery means 28 of the wrench head receives its supply of air via air delivery line 30 which is located within the wrench handle 14. Air delivery line 30 terminates outside of the wrench handle in a quick connect coupling 30a to which may be attached an air supply hose 32 via a quick connect coupling 32a mating with coupling 30a. The wrench handle 14 encloses a hand actuated open/close valve 30b located in air delivery line 30. Valve 30b is operated to its open position by depressing a spring biased pivoted valve opener 30c which is normally biased so that valve 30b is closed. The annular gear wheel 18 of the head section 12 of the pneumatic torque wrench of the invention bears downwardly depending wrench drive lugs 34, each comprised of a lug body portion 34a, a lug torque plate drive portion 34b and a lug fastener portion 34c via which each drive lug is threaded into gear wheel 18.

Figure 3:
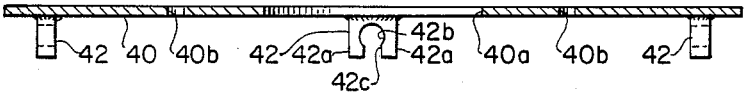
FIG. 3 is a side sectional view of a torque plate of the type used to interconnect the pneumatic torque wrench of the invention to a handwheel of a large gate, globe, angle or cross valve.
Figure 4:
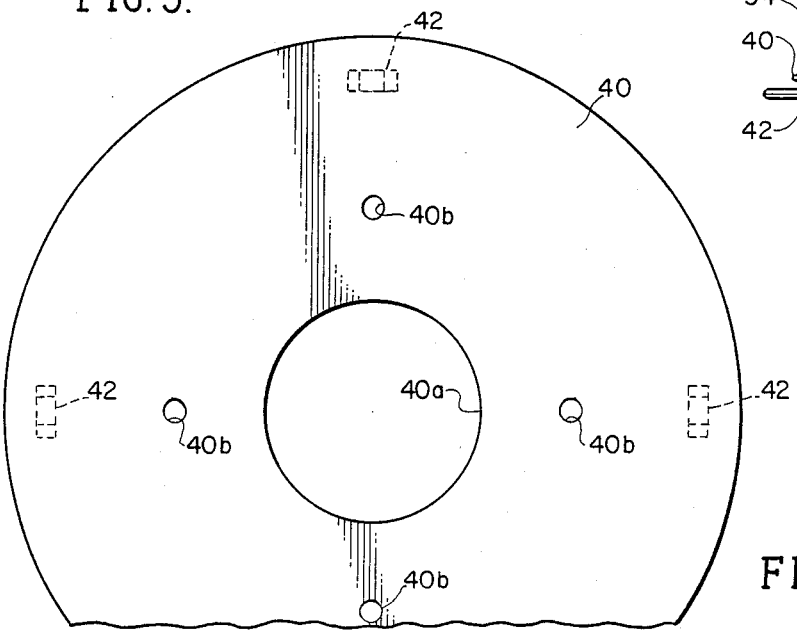
FIG. 4 is a plan view of the torque plate of FIG. 3.

Associated with the pneumatic torque wrench 10 is a torque plate 40 of circular design and formed with a central opening 40a. The torque plate 40, as shown in FIGS. 3 and 4, contains lug drive openings 40b matching in number and position the torque plate drive portions 34b of drive lugs 34 which depend downwardly from the gear wheel 18 of wrench 10. Depending downwardly from the underside of torque plate 40 is an annular array of valve handwheel spoke grips 42. The number and spacing of such spoke grips, on any given torque plate, is dependent upon the number of spoke presented by the handwheel to which a torque plate 40 is to be applied. Thus, a set of torque plates 40 with 4 to 6 or more spoke grips should be available for use with the pneumatic torque wrench of the invention. Each spoke grip 42 (see FIG. 3) includes side legs 42a which are shaped to straddle a handwheel spoke via central opening 42b. The bottom gap 42c between legs 42a is of sufficient dimension so that the grip 42 fits over a handwheel spoke and upon application to the torque plate of a strong torque turning force by the torque wrench 10 (through the latter's drive lugs 34 seated in torque plate opening 40b) the handwheel spoke seats at one side or the other of the grip opening 42b so that the plate 40 will not readily jump from such spoke.

Figure 5:
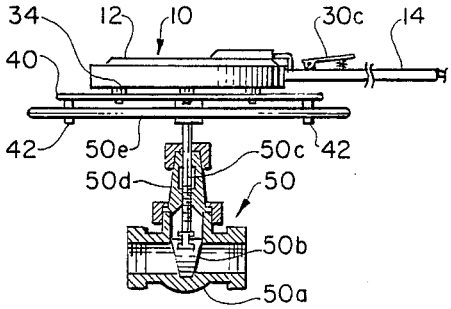
FIG. 5 is a side view of the pneumatic torque wrench of the invention in position, with an associated torque plate, on the handwheel of a typical gate valve.

The assemblage of the pneumatic torque wrench 10 of the invention, with an associated torque plate 40, in operative position on a valve handwheel is shown in FIG. 5. The valve 50 is of typical gate type and includes the valve body 50a, valve disk 50b (the movable obstruction to fluid flow through the valve body), threaded valve stem 50c, valve bonnet 50d, and handwheel 50e. In operation, turns of the handwheel cause the threaded stem 50c to lift or drop the valve disk 50b thereby opening or closing the valve body 50a to the passage of fluids therethrough. A torque plate 40, in accordance with the invention, is placed on the handwheel 50e of valve 50 with the plate's spoke grips 42 straddling the 4 to 6 (or more) spokes of the handwheel. The head section 12 of the pneumatic torque wrench 10 is then seated on the torque plate with the downwardly depending wrench drive lugs 34 positioned in the lug drive openings 40b in plate 40. With the air flow direction valve 28d of wrench 10 set for desired clockwise or counter-clockwise rotation of the annular gear wheel 18 (via rotation of air turbine wheel 22), the wrench operator (while firmly holding the wrench handle section 14 against rotation) depresses the open/close valve 30b thereby allowing air flow to the turbine wheel 22 via one of the air nozzles 28b or 28c with the resulting rotation of the handwheel 50e of valve 50. As previously indicated, if the valve is "frozen," the air turbine wheel 22 will not turn and air ceases to flow to such wheel. The operator may then apply direct arm force to the wrench handle section 14 of the wrench 10 to "break" the freeze resistance of the valve components to movement by the handwheel.

The wrench head section 12 of the pneumatic torque wrench 10 should have a diameter of at least 50% of the diameter of the handwheel to which it is to be applied. Further, the wrench handle section 14 of the wrench 10 should have a length of at least two times the diameter of the wrench head section so that the operator is provided with adequate lever arm length to hold the wrench against its turning force as generated by the air turbine wheel and gear chain.

Referring now to FIGS. 6 and 7 there is illustrated an alternative form of a reversible pneumatic torque wrench 60 in accordance with the present invention. The wrench 60 is adapted for use in the force rotation of handwheels associated with large gate, globe, angle and cross valves of the type commonly having an extended-length valve stem. The basic components of the torque wrench 60 are its head section 62 and handle section 64 (shown in FIG. 9). The head section 62 includes a main wrench-head housing 62a comprised of a central turbine cover portion 62b, annular transition wall portion 62c, outer annular bearing race cover portion 62d and outer annular (depending) housing wall portion 62e. The central turbine cover portion 62b of the head housing 62a includes a central turbine opening 62f and spur gear shaft openings 62g outwardly spaced from the central turbine opening 62f.

The wrench-head housing 62a, via its outer annular wall portion 62e, supports a ball bearing assembly 66 including a sectioned outer ball race 66a, inner ball race 66b and bearing balls 66c. The annular outer race 66a is affixed to the housing wall portion 62e in known manner and through the bearing balls 66c supports and stabilizes (within the wrench-head housing) the inner ball race 66b. The balls of bearing assembly 66 are maintained in equally spaced position by a ball frame (not shown) of known construction which is positioned between the races 66a and 66b of bearing 66. The inner ball race 66b comprises the peripheral portion of annular gear wheel 68 which bears about its inner periphery gear teeth 68a. Intermeshed with the gear teeth 68a of gear wheel 68 is an inner annular array of evenly spaced spur gears 70 which are each positioned by their respective gear shafts 70a (extending through gear shaft openings 62g in turbine cover portion 62b of housing 62a) so that their gear teeth 70b properly mesh with the gear teeth 68a.

Centrally located within wrench-head housing 62a is an air turbine wheel 72 which includes a central hub 72a from which air vanes 72b extend radially to wheel 72. Air turbine wheel 72 bears on its outer periphery gear teeth 72c which mesh with the gear teeth 70b of the spur gears 70. The turbine wheel 72 is supported on bottom plate 74 of the wrench head 62. At the midpoint of bottom plate 74 there is located a central opening 74a and outwardly spaced therefrom are spur gear shaft openings 74b. The central turbine opening 74a of the bottom plate 74 is aligned with the turbine opening 62f in the central turbine cover portion 62b of housing 62a and the spur gear shaft openings 74b of the bottom plate 74 are aligned with the spur gear shaft openings 62g in the turbine cover portion 62b of housing 62a. The air turbine wheel 72 rotates centrally within the head section 62 between the central turbine cover portion 62b and the bottom plate 74. The spur gear shafts 70a are affixed to spur gears 70 and extend through the aligned shaft openings 62g in the turbine cover portion 62b of housing 62a and the shaft openings 74b in the bottom plate 74. The spur gear shafts 70a are locked in shaft openings 62g and 74b by lock nuts 70c. The bottom plate 74, via its connection to housing 62a through spur gear shafts 70a, supports the air turbine wheel 72, spur gears 70 and the inner periphery of annular gear wheel 68.

The wrench head section 62 of torque wrench 60 is provided with air delivery means of the type previously described with respect to FIGS. 1 and 2. Thus, an air flow direction valve directs air from an air channel into either of two air nozzles. One air nozzle directs air to the turbine vanes 72b so that turbine wheel 74 driven in a counter-clockwise direction, thereby driving the spur gears 70 in a clockwise direction and in turn the annular gear wheel 68 in a clockwise direction. The other nozzle directs air to the turbine vanes 72b so that the turbine wheel 72 is driven in a clockwise direction, thereby driving the spur gears 70 in a counter-clockwise direction and in turn the annular gear wheel 68 in a counter-clockwise direction. The air entering turbine wheel 72 through either air nozzle (not shown), after performing its work on the turbine vanes 72b during one rotation of the turbine wheel, is exhausted from the turbine wheel through an exhaust channel in the bottom plate 74 (as shown in FIG. 2). An air throttle valve regulates air flow rate to the operative nozzle as directed by a flow direction valve (as shown in FIGS. 1 and 2).

The main air channel of the air delivery means of the wrench head receives its supply of air via an air delivery line which is located within the wrench handle (same as shown in FIGS. 1 and 2). The air delivery line terminates outside of the wrench handle in a quick connect coupling to which may be attached an air supply hose via a mating quick connect coupling. The wrench handle encloses a hand actuated open/close valve located in the air delivery line. The open/close valve is operated to its open position by depressing a spring biased pivoted valve opener which is normally biased so that the valve is closed (see particularly FIG. 9 wherein the valve and valve opener 80c are located near the outer end of wrench handle 64). The annular gear wheel 68 of the head section 62 of the torque wrench 60 of the invention bears downwardly depending wrench drive lugs 84, each comprised of a lug body portion 84a, a lug torque plate drive portion 84b and a lug fastener portion 84c via which each drive lug is threaded into gear wheel 68.

Associated with the pneumatic torque wrench 60 is a torque plate 90 of circular design and formed with a central opening 90a. The torque plate 90, as shown in FIG. 8, contains lug drive openings 90b matching in number and position the torque plate drive portions 84b of drive lugs 84 which depend downwardly from the gear wheel 68 of wrench 60. Depending downwardly from the underside of torque plate 90 is an annular array of valve handwheel spoke grips 92. The number and spacing of such spoke grips, on any given torque plate, is dependent upon the number of spokes presented by the handwheel to which a torque plate is to be applied. Thus, a set of torque plates 90 with 4 to 6 (or more) spoke grips should be available for use with the pneumatic torque wrench of the invention. The spoke grips as shown in FIG. 8 are designed to be applied to a valve handwheel of the type that has its spokes sloped downwardly from the handwheel rim to a central hub as shown in FIG. 9. Thus, each spoke grip 92 (see FIG. 8) includes side legs 92a which are bent outwardly and are shaped to straddle a sloping handwheel spoke via central opening 92b. The bottom gap 92c between legs 92a is of sufficient dimension so that the grip 92 fits over a handwheel spoke and upon application to the torque plate of a strong torque turning force by the torque wrench 60 (through the latter's drive lugs 84 seated in torque plate openings 90b) the handwheel spoke seats at one side or the other of the grip opening 92b so that the plate 90 will not readily jump from such spoke.

The assemblage of the alternative pneumatic torque wrench 60 of the invention, with an associated torque plate 90, in operative position on a valve handwheel, is shown in FIG. 9. The valve 100 is of typical gate type and includes the valve body 100a, valve disk 100b (the movable obstruction to fluid flow through the valve body), threaded valve stem 100c of extended length, valve bonnet 100d, and handwheel 100e. The threaded valve stem 100c extends through the wrench head 62 as shown in FIGS. 7 and 9. In operation, turns of the handwheel 100e cause the threaded stem 100c to lift or drop the valve disk 100b thereby opening or closing the valve body 100a to the passage of fluids therethrough. A torque plate 90, in accordance with the invention, is placed on the handwheel 100e of valve 100 with the plate's spoke grips 92 straddling the 4 to 6 (or more) spokes 100f of the handwheel. The head section 62 of the torque wrench 60 is then seated on the torque plate with the downwardly depending wrench drive lugs 84 positioned in the lug drive openings 90b in plate 90. The extended length valve stem 100c extends through the center opening of the wrench head 62. With the air flow direction valve of the wrench 60 set for desired clockwise or counter-clockwise rotation of the annular gear wheel 68 (via rotation of air turbine wheel 72), the wrench operator (while firmly holding the wrench handle section 64 against rotation) depresses the open/close valve (via pivoted valve opener 80c) thereby allowing air flow to the turbine wheel 72 via one of the air nozzles with the resulting rotation of the handwheel 100e of the valve 100. As previously indicated, if the valve is "frozen," the air turbine wheel 72 will not turn and air ceases to flow to such wheel. The operator may then apply direct arm force to the wrench handle section 64 of the wrench 60 to "break" the freeze resistance of the valve components to movement by the handwheel.

The wrench head section 62 of the torque wrench 60 should (as in the case of the embodiment of the wrench shown in FIGS. 1 through 5) have a diameter of at least 50% of the diameter of the handwheel to which it is to be applied and the wrench handle section 64 of the wrench should have a length of at least two times the diameter of the wrench head section so that the operator is provided with adequate lever arm length to hold tha wrench against its turning force as generated by the air turbine wheel and gear chain.

In the specification and drawing figures there has been set forth preferred embodiments of the invention and although specific terms have been employed, they are used in a generic and descriptive sense only and not for purposes of limitation, the scope of the invention being defined in the following claims.

What is claimed is:

1. A pneumatic torque wrench for turning the handwheels of large gate, globe, angle and cross valves and the like, comprising:

(a) a wrench head section including:

(i) a housing;

(ii) a central air turbine wheel rotatably mounted within said housing and bearing gear teeth on its outer periphery;

(iii) at least three like spur gears rotatably mounted within said housing and located in uniformly spaced position about said turbine wheel and in gear mesh relationship with the gear teeth of said turbine wheel;

(iv) an annular gear ring rotatably mounted within said housing and bearing gear teeth on its inner periphery, the gear teeth of said annular ring being in gear mesh relationship with said spur gears and said annular ring bearing on its outer periphery a ball race comprising the inner race of an annular ball type bearing; and (v) an outer ball race mounted in fixed outer peripheral relationship within said housing and interfacing in bearing relationship with the inner ball race and bearing balls maintained in equally spaced position between said inner and outer ball races to form therewith said annular ball type bearing to rotationally support said annular gear ring;

(b) air inlet channel means associated with the wrench head section for the delivery of air to said air turbine wheel to rotate said wheel and thereby, through said spur gears, rotate with increased force the annular gear ring of said wrench, and air outlet channel means associated with the wrench head section at a point removed from said air inlet means for exhausting air from said turbine;

(c) a wrench handle section mounted to the housing of said head section and extending outwardly therefrom as a lever arm, said handle section including:

(i) an air line for the delivery of air to the air inlet channel means associated with the wrench head section; and (ii) open and close valve means for admitting and stopping the admission of air flow through the air delivery line; and (d) drive means mounted to the underside of the annular gear ring and extending downwardly from the housing of said wrench head section to interact with the handwheel of a valve and, upon the delivery of air to said turbine wheel, provide rotational torque force to said handwheel.

2. A pneumatic torque wrench as claimed in claim 1 wherein the air inlet channel means associated with the wrench head section for the delivery of air to said turbine wheel includes a first air delivery nozzle for directing air to said turbine wheel to drive said wheel in a clockwise direction, a second air delivery nozzle for directing air to said turbine wheel to drive said wheel in a counter-clockwise direction, and an air flow direction valve for directing air to either said first nozzle or said second nozzle

3. A pneumatic torque wrench as claimed in claim 1 wherein the air inlet channel means associated with the wrench head section for the delivery of air to said turbine wheel includes an air throttle valve to regulate the air flow rate within said air inlet channel.

4. A pneumatic torque wrench as claimed in claim 1 wherein the drive means mounted to the underside of the annular gear ring comprises downwardly depending lugs which engage a torque plate positioned on said handwheel so as to grip the spokes thereof by spoke grips mounted to the underside of said plate.

5. A pneumatic torque wrench as claimed in claim 1 wherein the housing of the wrench head section is comprised of: a main top housing member including a central turbine cover portion, annular transition wall portion, outer annular ball type bearing cover portion and an outer depending housing wall portion; and a bottom plate, said outer depending wall portion of said top housing member having mounted thereto the outer ball race of said bearing.

6. A pneumatic torque wrench as claimed in claim 5 wherein the spur gears each include a gear shaft extending through the central turbine cover portion and through the bottom plate for rotatably mounting said gears within the housing of the wrench head section.

7. A pneumatic torque wrench as claimed in claim 5 wherein the central air turbine wheel includes a turbine shaft extending through the central turbine cover portion and through the bottom plate for rotatably mounting said turbine wheel within the housing of the wrench head section.

8. A pneumatic torque wrench as claimed in claim 5 wherein the central turbine cover portion and the bottom plate of the housing of the wrench head section each include a central opening and the central air turbine wheel within said housing has a central opening in alignment with the central openings of said turbine cover portion and said bottom plate whereby the center area of the wrench head section of said wrench is open to receive an extended-length valve stem.

9. A pneumatic torque wrench as claimed in claim 8 wherein the central air turbine wheel is maintained in its rotatably mounted position within the housing of the wrench head section by the spur gears in their uniformly spaced position about said turbine wheel.

10. A pneumatic torque wrench as claimed in claim 8 wherein the drive means mounted to the underside of the annular gear ring comprises downwardly depending lugs which engage a torque plate of circular configuration positioned on the handwheel of a valve so as to grip the spokes thereof by spoke grips mounted to the underside of said plate, said torque plate having a central opening in alignment with the open central area of the wrench head section to receive an extended-length valve stem.

11. A pneumatic torque wrench for turning the handwheels of large gate, globe, angle and cross valves and the like, comprising:

(a) a wrench head section including:

(i) a housing;

(ii) a central air turbine wheel rotatably mounted within said housing and bearing gear teeth on its outer periphery;

(iii) a multiplicity of like spur gears rotatably mounted within said housing and located in uniformly spaced position about said turbine wheel and in gear mesh relationship with the gear teeth of said turbine wheel;

(iv) an annular gear ring rotatably mounted within said housing and bearing gear teeth on its inner periphery, the gear teeth of said annular ring being in gear mesh relationship with said spur gears and said annular ring bearing on its outer periphery a bearing race comprising the inner race of an annular bearing assembly; and (v) an outer bearing race mounted in fixed outer peripheral relationship within said housing and interfacing in bearing relationship with the inner bearing race and bearings maintained in equally spaced position between said inner and outer bearing races to form therewith said annular bearing assembly to rotationally support said annular gear ring;

(b) air inlet channel means associated with the wrench head section for the delivery of air to said air turbine wheel to rotate said wheel and thereby, through said spur gears, rotate with increased force the annular gear ring of said wrench, and air outlet channel means associated with the wrench head section at a point removed from said air inlet means for exhausting air from said turbine;

(c) a wrench handle section mounted to the housing of said head section and extending outwardly therefrom as a lever arm, said handle section including:

(i) means for the delivery of air under pressure to air inlet channel means associated with the wrench head section; and (ii) valves means for admitting and for stopping the admission of air flow through the air inlet channel means; and (d) drive means mounted to the underside of the annular gear ring and extending downwardly from the housing of said wrench head section to interact with the handwheel of a valve and, upon the delivery of air to said turbine wheel, provide rotational torque force to said handwheel.

12. A pneumatic torque wrench as claimed in claim 11 wherein the drive means mounted to the underside of the annular gear ring comprises a multiplicity of annularly positioned and downwardly depending lugs which engage in rotational drive relationship a circular torque plate removably positioned on said handwheel so as to grip the spokes thereof by spoke grips mounted to the underside of said plate.

* * * * *